US009234318B2

(12) United States Patent
Pietila et al.

(10) Patent No.: US 9,234,318 B2
(45) Date of Patent: Jan. 12, 2016

(54) ROLLER PLOW ASSEMBLY FOR CONCRETE SCREEDING MACHINE

(71) Applicant: SOMERO ENTERPRISES, INC., Fort Myers, FL (US)

(72) Inventors: Mark A. Pietila, Atlantic Mine, MI (US); Philip D. Halonen, Calumet, MI (US)

(73) Assignee: SOMERO ENTERPRISES, INC., Ft. Myers, FL (US)

( * ) Notice: Subject to any disclaimer, the term of this patent is extended or adjusted under 35 U.S.C. 154(b) by 0 days.

(21) Appl. No.: 14/290,027

(22) Filed: May 29, 2014

(65) Prior Publication Data

US 2014/0363232 A1 Dec. 11, 2014

Related U.S. Application Data

(60) Provisional application No. 61/831,871, filed on Jun. 6, 2013.

(51) Int. Cl.
*E01C 19/40* (2006.01)
*E01C 19/23* (2006.01)

(52) U.S. Cl.
CPC ..... *E01C 19/405* (2013.01); *E01C 19/238* (2013.01)

(58) Field of Classification Search
CPC ..... E01C 19/405; E01C 19/41; E01C 19/238
See application file for complete search history.

(56) References Cited

U.S. PATENT DOCUMENTS 1,731,231 A 10/1929 Chenoweth
1,736,412 A 11/1929 Lichtenberg
1,736,413 A 11/1929 Lichtenberg
1,755,653 A 4/1930 Koehring
2,025,703 A 12/1935 Baily et al.
2,266,655 A 12/1941 Naget
2,635,888 A * 4/1953 Bailiff ..... 172/246
2,650,525 A 9/1953 Jones
3,009,401 A 11/1961 Greiner
3,072,025 A 1/1963 Cronin
3,306,175 A 2/1967 Ferwerda
3,402,648 A 9/1968 Modesto et al.
3,477,535 A 11/1969 Wyatt
3,698,293 A 10/1972 Wagner
3,870,427 A 3/1975 Allen
4,043,738 A 8/1977 Modesto et al.
4,115,976 A 9/1978 Rohrer
4,142,815 A 3/1979 Mitchell
4,157,877 A 6/1979 Lee
4,167,360 A 9/1979 Dick, Jr.

(Continued)

*Primary Examiner* — Abigail A Risic

(74) *Attorney, Agent, or Firm* — Gardner, Linn, Burkhardt & Flory, LLP

(57) ABSTRACT

A screeding machine for screeding an uncured concrete surface includes a wheeled unit having a plurality of wheels for moving the wheeled unit over a support surface. A screed head assembly includes a grade setting device and a vibrating member and is movable over the concrete area via the wheeled unit. The grade setting device includes an at least partially cylindrical concrete engaging surface, such as a roller that is rotatably mounted at the screed head assembly and rotatably driven about its longitudinal axis. The screed head assembly may include a wiper element disposed along the roller and configured to wipe or remove excess concrete from the roller during rotation of the roller about its longitudinal axis. The grade setting device or roller plow assembly may be provided as an aftermarket kit for attachment at a screed head assembly of a screeding machine.

16 Claims, 16 Drawing Sheets

(56) References Cited

U.S. PATENT DOCUMENTS

| | | | | | |
|---|---|---|---|---|---|
| 4,231,678 | A | | 11/1980 | Carternock | |
| 4,280,800 | A | | 7/1981 | Bunn | |
| 4,345,888 | A | | 8/1982 | Brunemann | |
| 4,572,704 | A | | 2/1986 | Allen | |
| 4,614,486 | A | | 9/1986 | Bragagnini | |
| 4,655,633 | A | | 4/1987 | Somero et al. | |
| 4,661,011 | A | | 4/1987 | Halim | |
| 4,702,640 | A | * | 10/1987 | Allen | 404/75 |
| 4,712,943 | A | | 12/1987 | Alvarrson | |
| 4,737,050 | A | | 4/1988 | El Halim | |
| 4,747,726 | A | | 5/1988 | Garner et al. | |
| 4,775,306 | A | | 10/1988 | Kikuchi et al. | |
| 4,913,584 | A | | 4/1990 | Garner et al. | |
| 4,930,935 | A | | 6/1990 | Quenzi et al. | |
| 4,964,754 | A | | 10/1990 | Garner et al. | |
| 4,978,246 | A | | 12/1990 | Quenzi et al. | |
| 4,993,869 | A | | 2/1991 | Ulmer et al. | |
| 5,039,249 | A | | 8/1991 | Hansen et al. | |
| 5,046,889 | A | | 9/1991 | Sterner, Jr. | |
| 5,061,115 | A | | 10/1991 | Godbersen et al. | |
| 5,062,738 | A | * | 11/1991 | Owens | 404/114 |
| 5,088,855 | A | | 2/1992 | Giliberti | |
| 5,190,400 | A | | 3/1993 | Sterner | |
| 5,222,828 | A | * | 6/1993 | Magalski | 404/103 |
| 5,228,799 | A | | 7/1993 | Sondreal | |
| 5,281,050 | A | | 1/1994 | Howard | |
| 5,311,727 | A | | 5/1994 | Fassauer | |
| 5,328,295 | A | | 7/1994 | Allen | |
| 5,456,549 | A | | 10/1995 | Paladeni | |
| 5,483,788 | A | | 1/1996 | Fassauer | |
| 5,507,593 | A | | 4/1996 | Hollon et al. | |
| 5,526,590 | A | | 6/1996 | Palm et al. | |
| 5,562,361 | A | | 10/1996 | Allen | |
| 5,664,908 | A | | 9/1997 | Paladeni | |
| 5,803,656 | A | | 9/1998 | Turck | |
| 6,071,458 | A | | 6/2000 | Mossi | |
| 6,227,761 | B1 | * | 5/2001 | Kieranen et al. | 404/84.5 |
| 6,402,425 | B1 | | 6/2002 | Paladeni | |
| 6,530,720 | B1 | | 3/2003 | Green | |
| 6,695,532 | B2 | | 2/2004 | Somero et al. | |
| 7,544,012 | B2 | * | 6/2009 | Lura | 404/118 |
| 2004/0190991 | A1 | * | 9/2004 | Quenzi et al. | 404/118 |
| 2005/0207843 | A1 | * | 9/2005 | Jackson | 404/118 |
| 2009/0252554 | A1 | * | 10/2009 | Lura | 404/119 |
| 2010/0183370 | A1 | * | 7/2010 | Lura | 404/118 |
| 2010/0196096 | A1 | * | 8/2010 | Halonen et al. | 404/84.1 |
| 2011/0188930 | A1 | * | 8/2011 | Lura | 404/118 |

* cited by examiner

ROLLER PLOW ASSEMBLY FOR CONCRETE SCREEDING MACHINE

CROSS REFERENCE TO RELATED APPLICATION

The present application claims the filing benefits of U.S. provisional application Ser. No. 61/831,871, filed Jun. 6, 2013, which is hereby incorporated herein by reference in its entirety.

FIELD OF THE INVENTION

The present invention relates generally to an apparatus and method for improving the operation of a concrete screeding machine during the leveling and smoothing of freshly poured concrete that has been placed over a surface.

BACKGROUND OF THE INVENTION

Screeding devices or machines are used to level and smooth uncured concrete to a desired grade. Known screeding machines typically include a screed head, which includes a vibrating member and a grade setting device, such as a plow and an auger device. The screed head is vertically adjustable, such as in response to a laser leveling system, to establish the desired grade at the vibrating member. Examples of such screeding machines are described in U.S. Pat. Nos. 4,655,633; 4,930,935; 6,227,761; 7,044,681; 7,175,363; and 7,396,186, which are hereby incorporated herein by reference in their entireties.

The plow is disposed in front of the auger device, which is disposed in front of the vibrating member. The plow typically has a sharp edge that cuts into the uncured concrete surface to establish the desired grade ahead of the auger. Because of the tendency for the sharp-edged plow to catch and drag stones and aggregate, the plow height is typically about one half inch or more above the grade of the auger to limit any grooves or channels caused by the dragging stones from being too deep for the auger to correct.

SUMMARY OF THE INVENTION

The present invention provides a screeding machine that comprises a screed head having a vibrating member and a grade setting device. The grade setting device comprises an auger device and a roller device disposed in front of the auger device.

According to an aspect of the present invention, a screed head includes a vibrating member, an auger disposed in front of the vibrating member and a rounded plow device in front of the auger. The rounded plow device provides at least a partial cylindrical concrete engaging surface for engaging the concrete in front of the auger as the screed head is moved over and along the concrete surface during a screeding operation. The plow device engages the concrete surface to establish the desired initial grade of the concrete surface ahead of the auger, which then further establishes the grade of the concrete surface ahead of the vibrating member.

The rounded or cylindrical plow device may comprise a cylindrical roller that is rotatably mounted at the screed head and rotatable about a longitudinal axis that is generally parallel to an axis of the auger and/or generally normal to the screeding direction. Optionally, the roller may be rotatably driven via a motor at one or both ends of the roller. For example, the roller may rotate in an opposite direction from its rolling direction (if it were rolling along the concrete surface in the screeding direction). Optionally, the roller may be freely rotatable about its axis as the screed head moves over the concrete surface in the screeding direction. Optionally, the cylindrical plow device may comprise a fixed or non-rotatable partial cylinder that provides a partial cylindrical surface that engages the concrete surface to establish the desired initial grade of the concrete ahead of the auger.

Therefore, the present invention provides a roller plow assembly or device that has a roller element or partial cylindrical element disposed ahead of the auger assembly of the screed head, whereby the rounded or curved profile or surface of the roller or rollers or non-rotatable structure tends to press stones or aggregate into the concrete and limit or substantially preclude dragging of larger stones or aggregate as may occur during use of a conventional sharp edged plow. Because the roller plow limits such dragging of stones, the roller plow may be set at a level closer to the auger grade than the level of a conventional plow, whereby the roller plow moves more excess concrete in front of the auger and the auger may process and move less concrete.

These and other objects, advantages, purposes and features of the present invention will become apparent upon review of the following specification in conjunction with the drawings.

DESCRIPTION OF THE PREFERRED EMBODIMENTS

Figure 1:
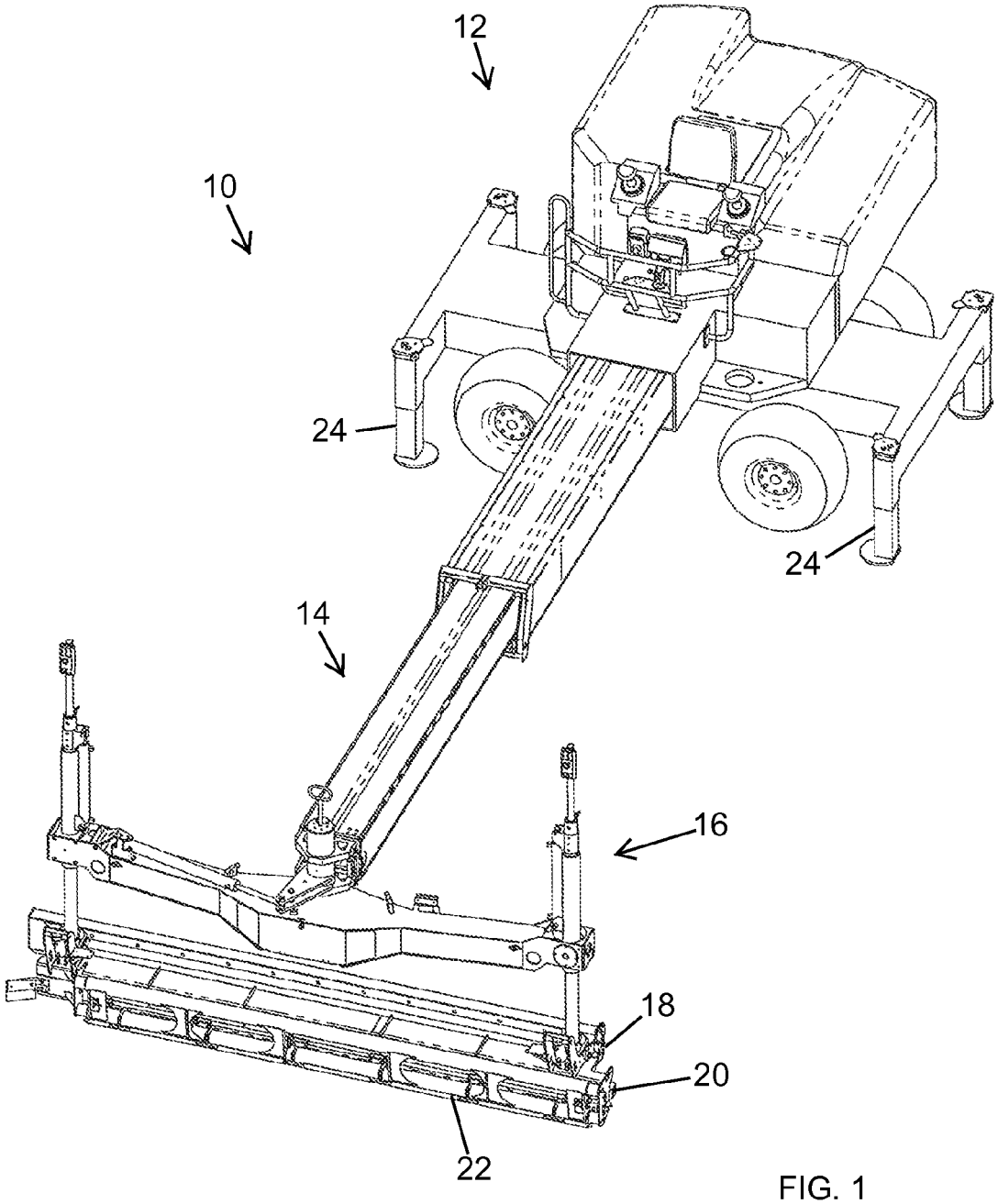
FIG. 1 is a perspective view of a concrete leveling and screeding machine that incorporates the screed head apparatus and roller plow of the present invention.
Figure 2:
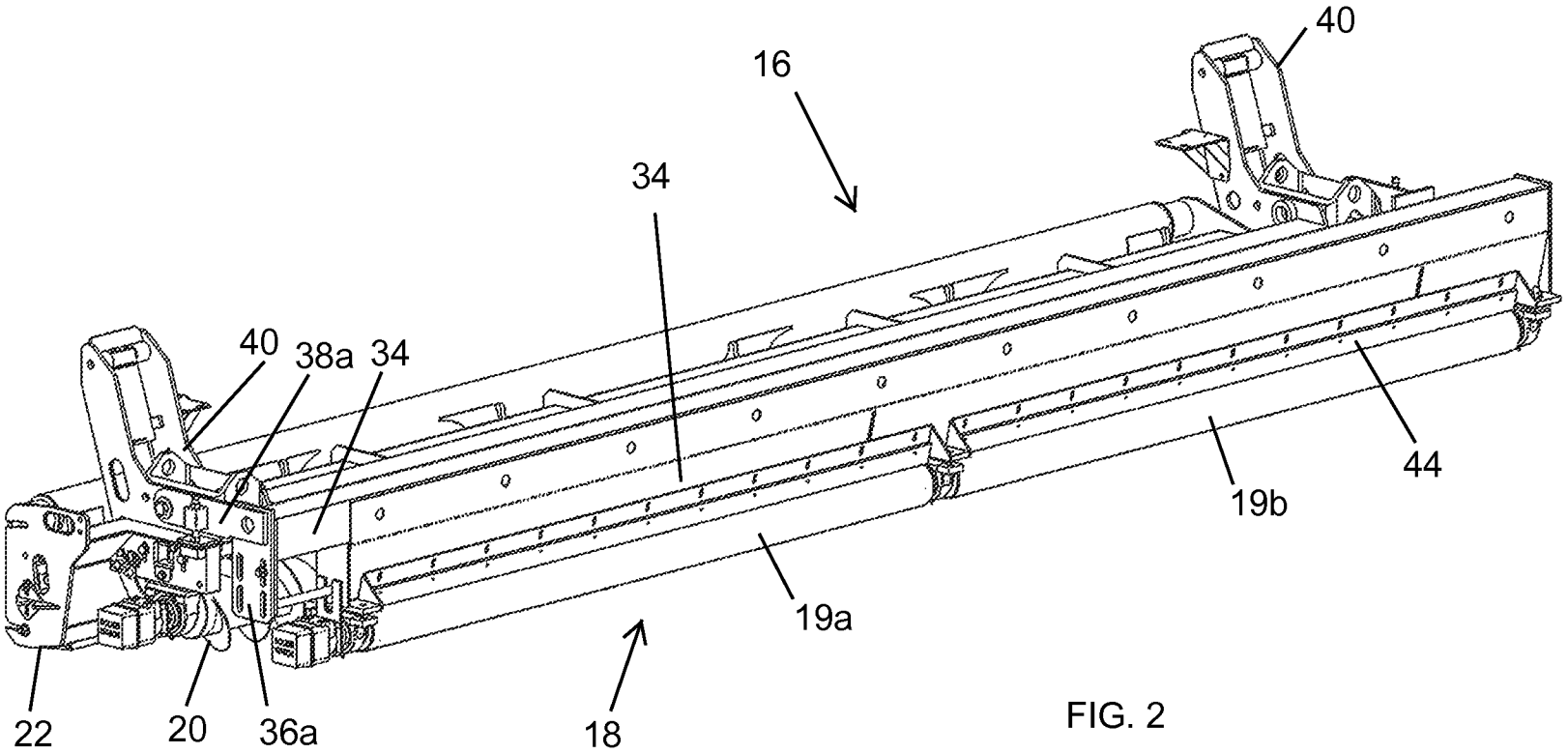
FIG. 2 is a perspective view of the screed head apparatus of FIG. 1.
Figure 3:
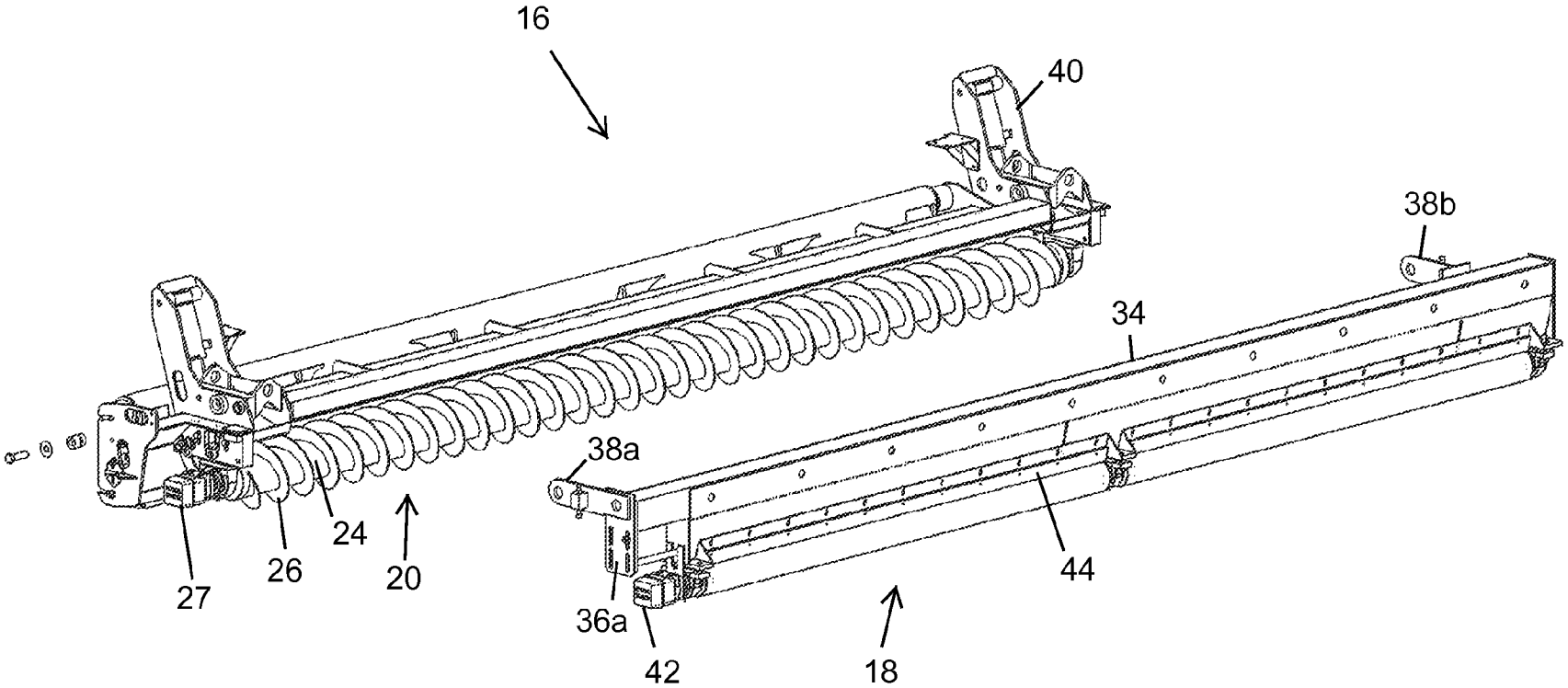
FIG. 3 is an exploded perspective view of the screed head apparatus of FIG. 2.

Referring now to the drawings and the illustrative embodiments depicted therein, a screeding machine 10 includes a wheeled unit 12 with a boom 14 extending therefrom and supporting a screeding head or assembly 16 at an outer end thereof (FIG. 1). The wheeled unit 12 is drivable to a targeted area at a support surface with uncured concrete placed thereat, and the wheeled unit may rotate about a base portion to swing the boom and screeding head to a targeted location. The boom 14 is extendable and retractable to move the screeding head 16 over the placed concrete, while the screeding head 16 is operable to establish a desired grade of the concrete surface and smooth or finish or screed the concrete. In the illustrated embodiment, the screeding head includes a rotatable roller plow assembly 18, a grade setting device or auger 20 and a vibrating member 22 (FIGS. 1-3). The screeding machine includes a plurality of stabilizers 24 that are extendable and retractable to support and stabilize the machine on the support surface during the screeding operation. The roller plow assembly 18 of screeding head 16 comprises a cylindrical roller that is rotatably driven to rotate about its longitudinal axis to establish a desired initial grade of the concrete surface ahead of the auger and vibrating member, as discussed below.

Screeding machine 10 and the screeding head or assembly 16 may be similar in construction and/or operation as the screeding machines and screeding heads described in U.S. Pat. Nos. 4,655,633; 4,930,935; 6,227,761; 7,044,681; 7,175,363; and/or 7,396,186, and/or U.S. Publication Nos. US-2007-0116520 and/or US-2010-0196096, which are all hereby incorporated herein by reference in their entireties, such that a detailed discussion of the overall construction and operation of the screeding machines and screeding heads need not be repeated herein. For example, the screeding machine may comprise or may utilize aspects of a Somero SXP-D LASER SCREED™ screeding machine. However, clearly this example is not intended to limit the scope of the present application and clearly aspects of the present invention are suitable for use on other types of screeding machines. For example, the screeding head and roller plow of the present invention may be suitable for use on a smaller screeding machine, such as a machine of the types described in U.S. Pat. Nos. 6,976,805; 7,121,762; and/or 7,850,396, which are hereby incorporated herein by reference in their entireties.

As shown in FIG. 3, auger 20 comprises a generally cylindrical body or shaft 24, which has flightings or vanes 26 spirally or helically disposed therearound and therealong. The auger may be rotatably driven via a motor 27 or any suitable rotational driving device that rotates the auger body about its longitudinal axis. The auger may comprise any suitable auger device, and optionally may comprise different or varying flightings, such as by utilizing aspects of the augers and screed heads described in U.S. patent application Ser. No. 14/229,060, filed Mar. 28, 2014, which is hereby incorporated herein by reference in its entirety.

In the illustrated embodiment, roller plow assembly 18 comprises a pair of rollers 19*a*, 19*b* axially aligned and supported at outer ends 19*c* via respective outer bearing assemblies 28 and an inner ends 19*d* via a center bearing assembly 30. The bearing assemblies 28, 30 include brackets 32 that receive the bearings therein and that are configured to attach to a mounting beam or structure 34 (such as best seen with reference to FIGS. 4-6), which is configured for mounting to the screed head 16. Thus, the rollers 19*a*, 19*b* of roller plow assembly 18 are supported at their outside ends and at a generally central region of the screed head, in order to limit or substantially preclude sagging, deflection or flexing of the roller or rollers of the roller plow during operation of the screed head. The center bearing and mounting configuration thus supports the center region of the roller assembly and limits or overcomes the concern of excess deflection at the center that may otherwise arise with use of a single long thin roller. Optionally, the roller plow assembly may instead include a single roller that extends between opposite end supports (with no central support) and that may be sufficiently rigid to minimize or limit sagging or deflection of the roller during operation of the screed head.

Figure 4:
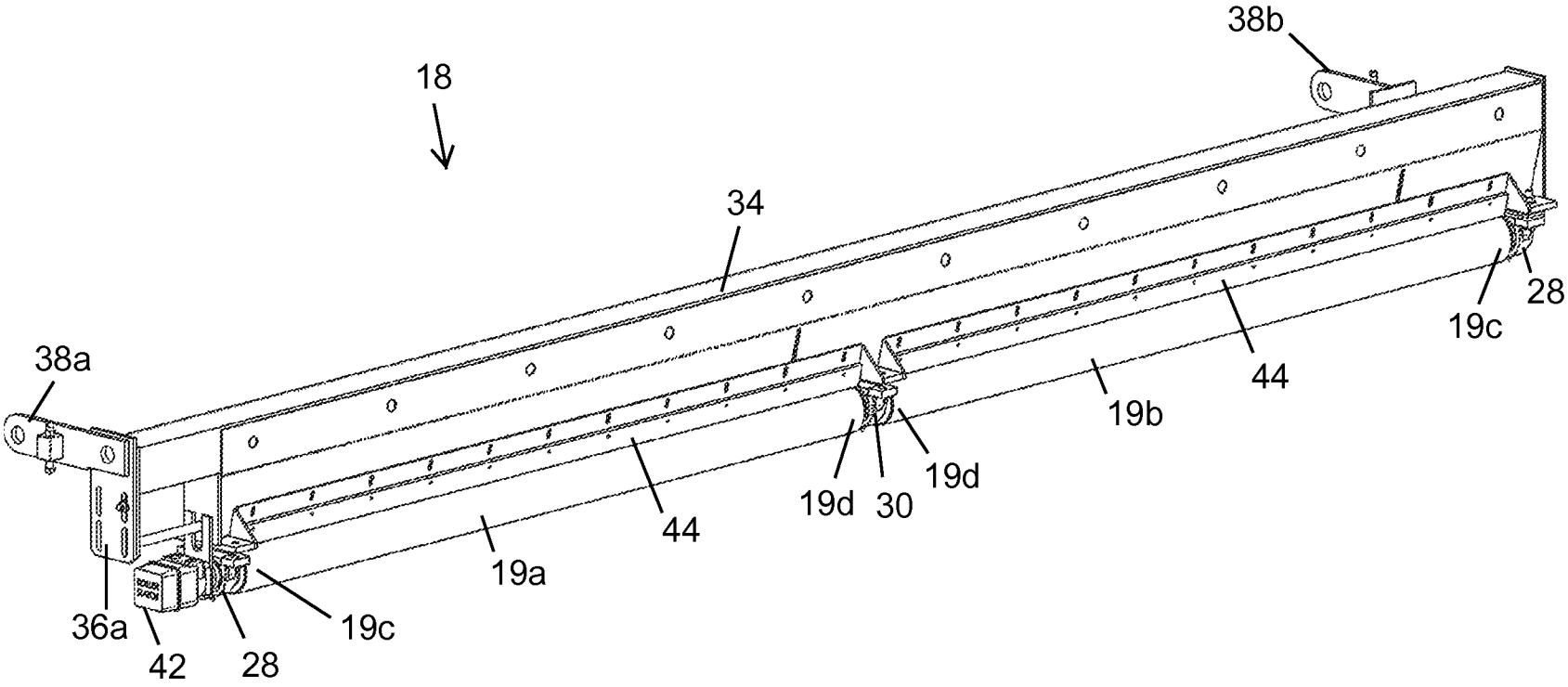
FIG. 4 is a perspective view of the roller plow assembly of the screed head apparatus of FIGS. 2 and 3.
Figure 5:
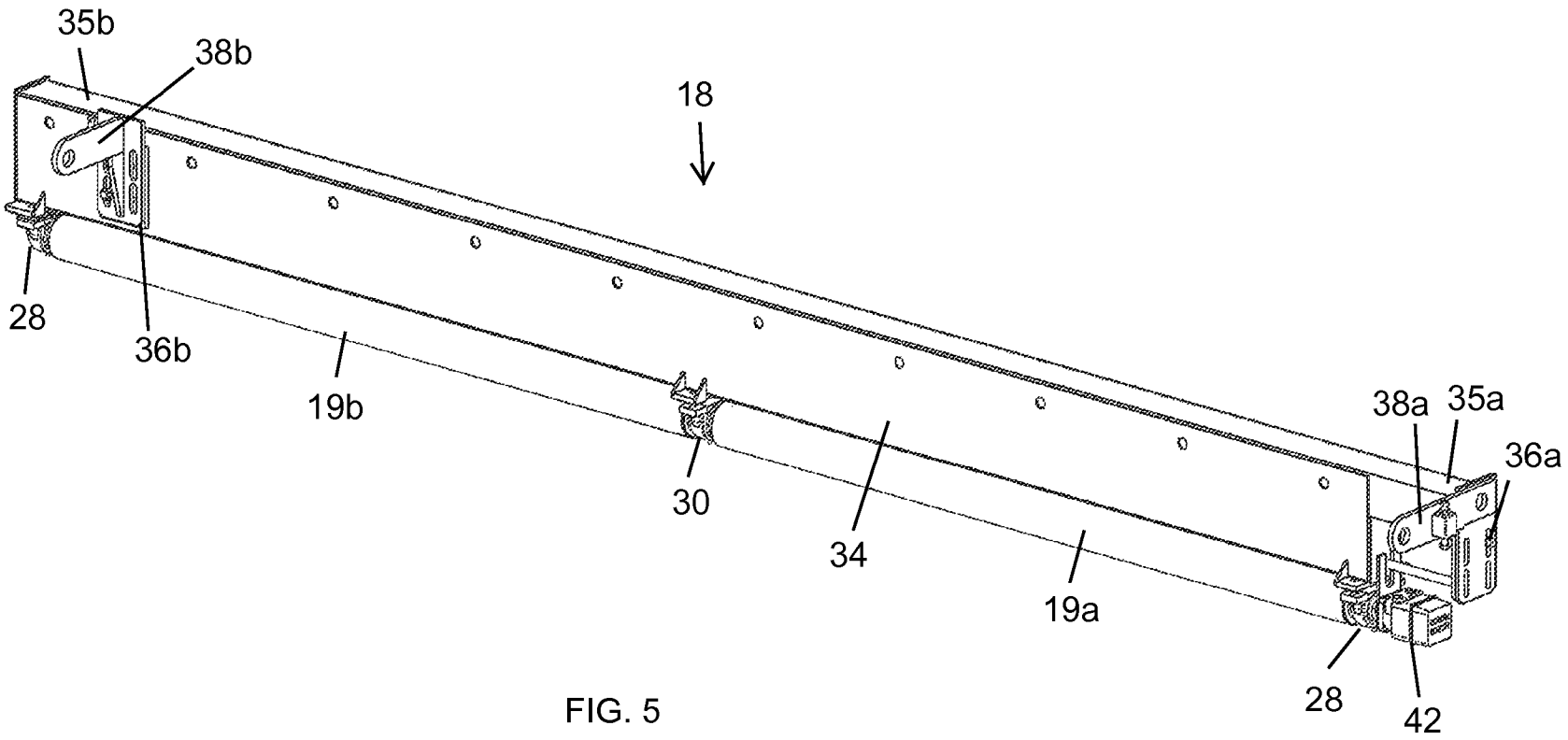
FIG. 5 is an opposite perspective view of the roller plow assembly of FIG. 4.
Figure 6:
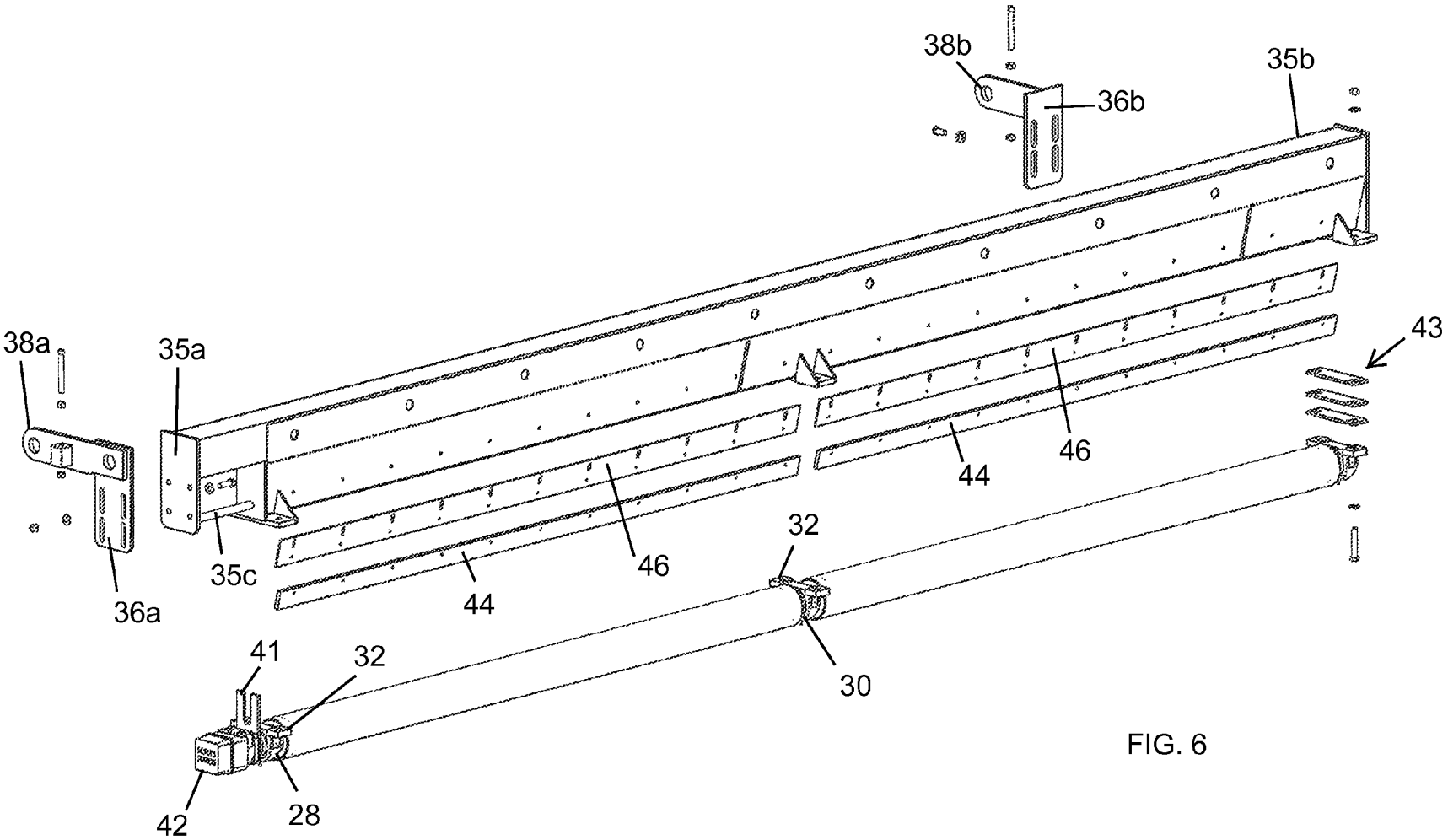
FIG. 6 is an exploded perspective view of the roller plow assembly of FIG. 4.
Figure 7:
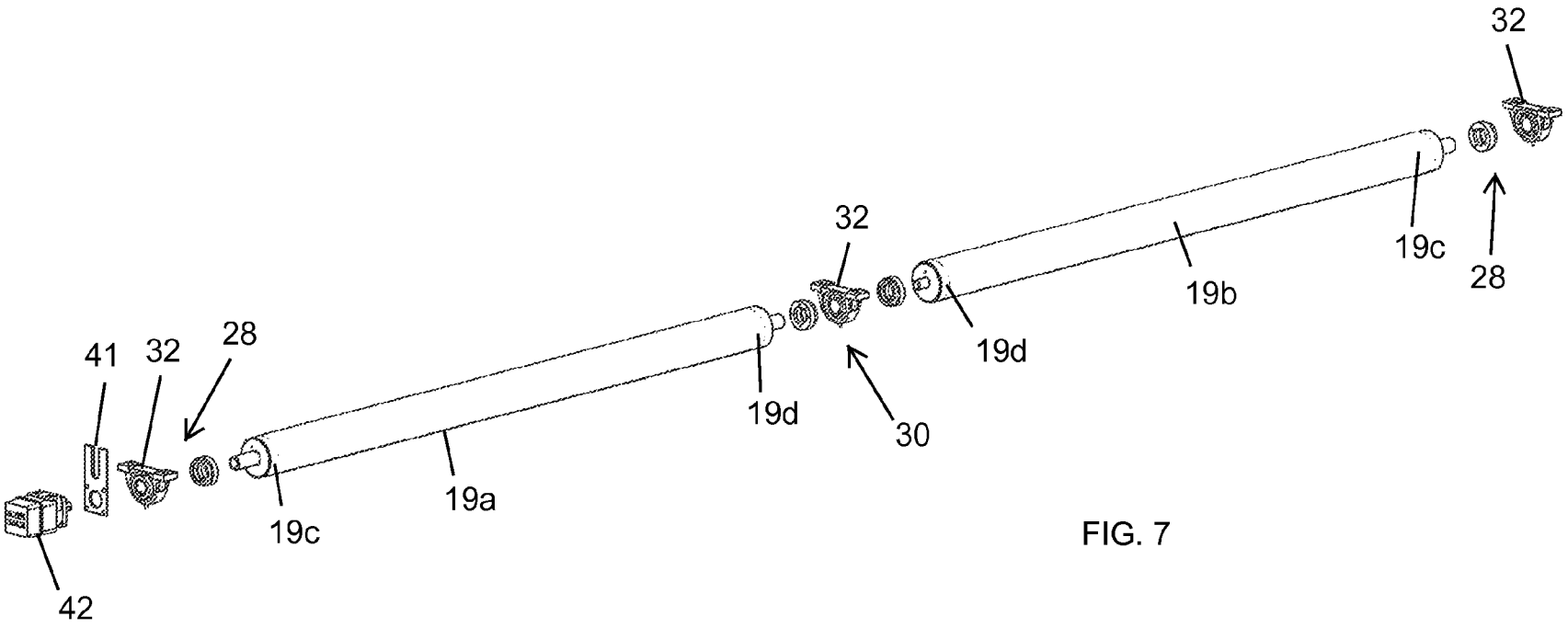
FIG. 7 is an exploded perspective view of the rollers and bearing and motor of the roller plow assembly of FIG. 6.
Figure 8:
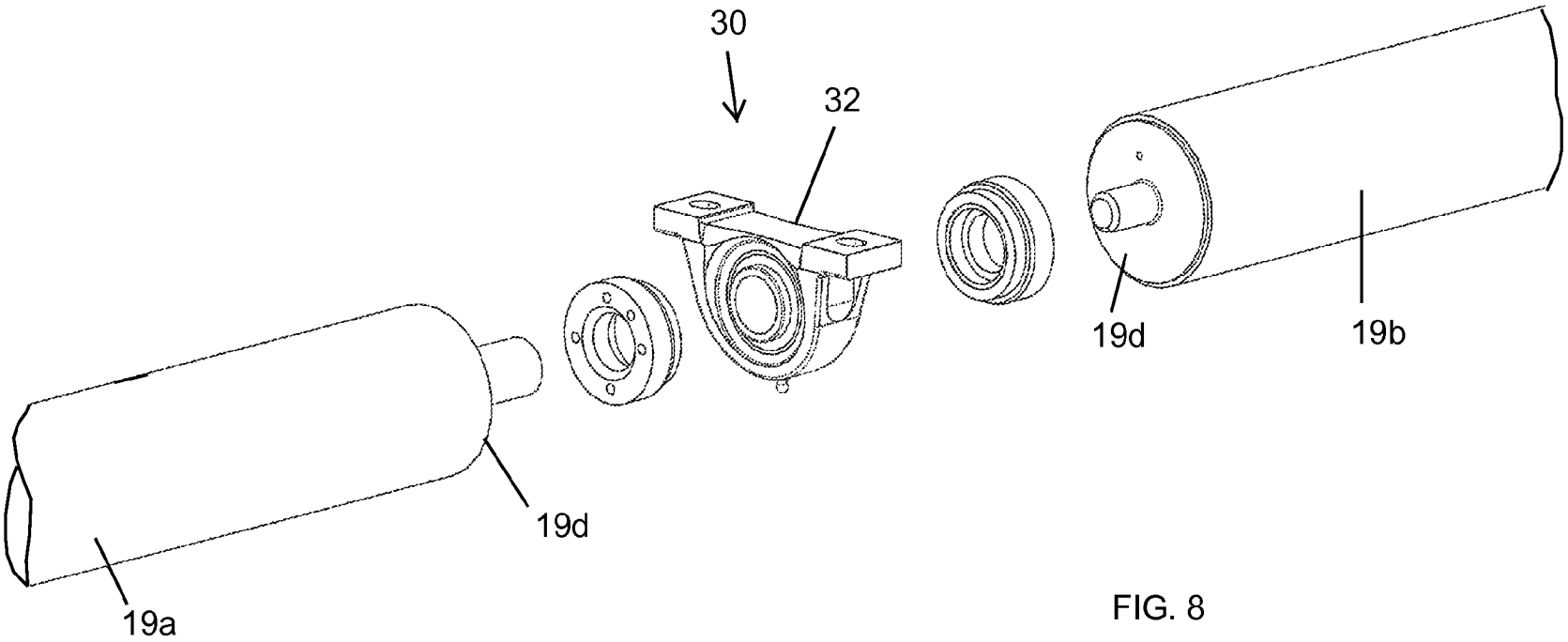
FIG. 8 is an enlarged perspective view of a center bearing disposed between the two rollers of FIG. 7.

The mounting beam 34 has an end or end bracket 35*a* at which a mounting bracket 36*a* is attached, with the mounting bracket 36*a* including an arm or bracket 38*a*, and the mounting beam 34 has an opposite end 35*b* with a mounting bracket 36*b* attached thereat and with an arm or bracket 38*b* attached at the bracket 36*b*. The arms or brackets 38*a*, 38*b* are configured for attachment at a frame portion 40 of the screed head. As shown in FIGS. 4-6, the mounting brackets 36*a*, 36*b* may include slotted openings for allowing for vertical adjustment of the respective ends of the mounting beam 34 and roller plow 18 relative to the frame portion 40.

End bracket 35*a* includes, at the respective end of the mounting beam 34, a post or rod 35*c*, which is received in a motor torque reaction guide bracket 41 at the end bearing assembly 28 and drive motor 42, to assist in positioning the drive motor 42 at the appropriate location relative to the mounting beam 34 when the rollers are attached thereto. The bearing bracket 32 at the opposite end of the rollers may be mounted at the opposite end of the mounting beam via any suitable attachment means, and may include one or more spacers or shim plates 43 disposed thereat to provide the desired mounting configuration of the rollers relative to the mounting beam. As shown in FIGS. 4-6, the mounting bracket 36*b* at the opposite end of the mounting beam from the drive motor may comprise a different construction but similar vertical adjustment feature and mounting arm or bracket.

Thus, the mounting arms or brackets 38*a*, 38*b* may be mounted to the screed frame 40 and the height of the roller or rollers may be set relative to the brackets 36*a*, 36*b* and the frame portion and thus relative to the auger 20 and vibrating member 22. For example, the height or grade of the rollers may be set to be about ¼ inch above the height or grade of the auger, which may be set slightly above the grade of the vibrating member (so that the vibrating member is set about ¼ inch below the auger grade). Thus, the roller plow 18 may operate to move excess concrete ahead of the auger and vibrating member so that most of the excess concrete is handled or moved by the roller, whereby a smaller amount of concrete is handled or moved or processed by the auger.

In the illustrated embodiment, the roller plow 18 includes a rotatable drive motor 42, which is operable to rotatably drive the rollers 18*a*, 18*b* about their longitudinal axes. The drive motor 42 may rotate the rollers in a direction opposite their rolling direction, such as in the direction A in FIG. 9. The roller thus defines a cylindrical contact surface or profile therealong that is configured to contact the surface of the uncured concrete as the rotatable roller is rotated over the uncured concrete surface. The roller is rotatable such that the cylindrical contact surface moves relative to the surface of the uncured concrete as the screed head and rollers are moved over the uncured concrete. The rotatably driven rollers may move aggregate or stones ahead of the auger and/or may press aggregate or stones into the uncured concrete as the screed head moves along the concrete surface, and limit or substantially preclude dragging of stones (such as often occurs with conventional sharp-edged plow members). Optionally, the roller drive system may utilize aspects of the concrete finishing devices described in U.S. Pat. No. 6,695,532, which is hereby incorporated herein by reference in its entirety. Optionally, the roller may be rotatably driven in the opposite direction, such as at a faster or slower rate than the rolling rate of the roller if it were not driven, such that the cylindrical contact surface moves relative to the concrete surface as the screed head moves along and over the concrete surface.

Figure 14:
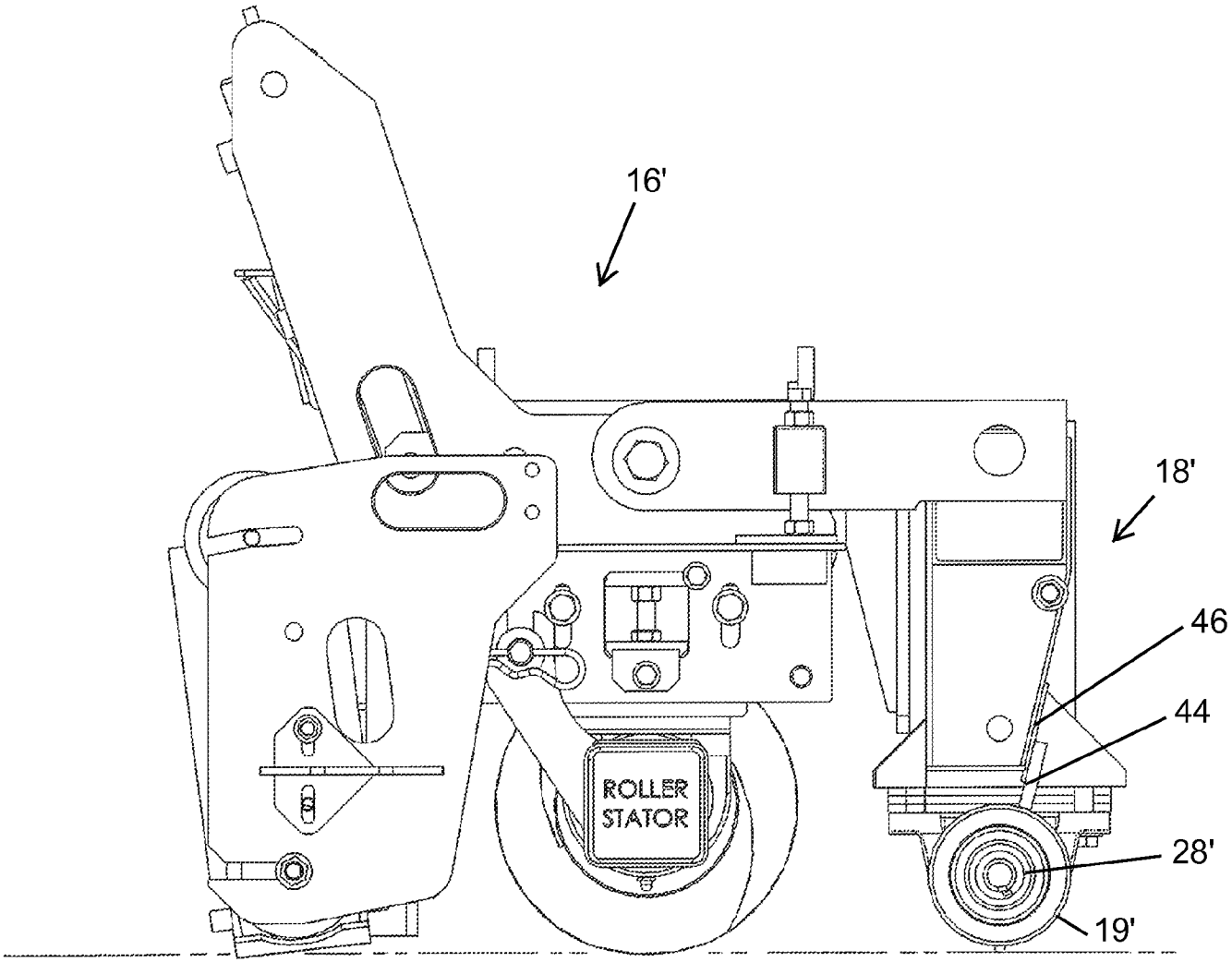
FIG. 14 is an end elevation of another screed head apparatus of the present invention, with a freely rotating or non-driven roller plow.

Optionally, the roller may not be rotatably driven and may freely rotate about its longitudinal axis. For example, and as shown in FIG. 14, a roller plow assembly 18' may be mounted at a screed head 16', such that the roller or rollers 19' of the roller plow 18' are mounted at their ends to respective end bearing assemblies 28' and center bearing assemblies, and freely rotate about the longitudinal axis of the rollers, with no drive motor attached thereto. The freely rotating rollers may press any aggregate or stones into the uncured concrete as the screed head moves along the concrete surface and limit or substantially preclude dragging of stones (such as often occurs with conventional sharp-edged plow members). The screed head 16' and roller plow assembly 18' may be otherwise similar to the screed head 16 and roller plow assembly 18, discussed above, such that a detailed discussion of the screed heads and roller plow assemblies need not be repeated herein. As shown in FIG. 14, the screed head 16' and roller plow assembly 18' may include a wiper element 44 and attaching plate or strip 46 for wiping excess concrete off of the roller during operation of the screed head, such as discussed below.

Figure 9:
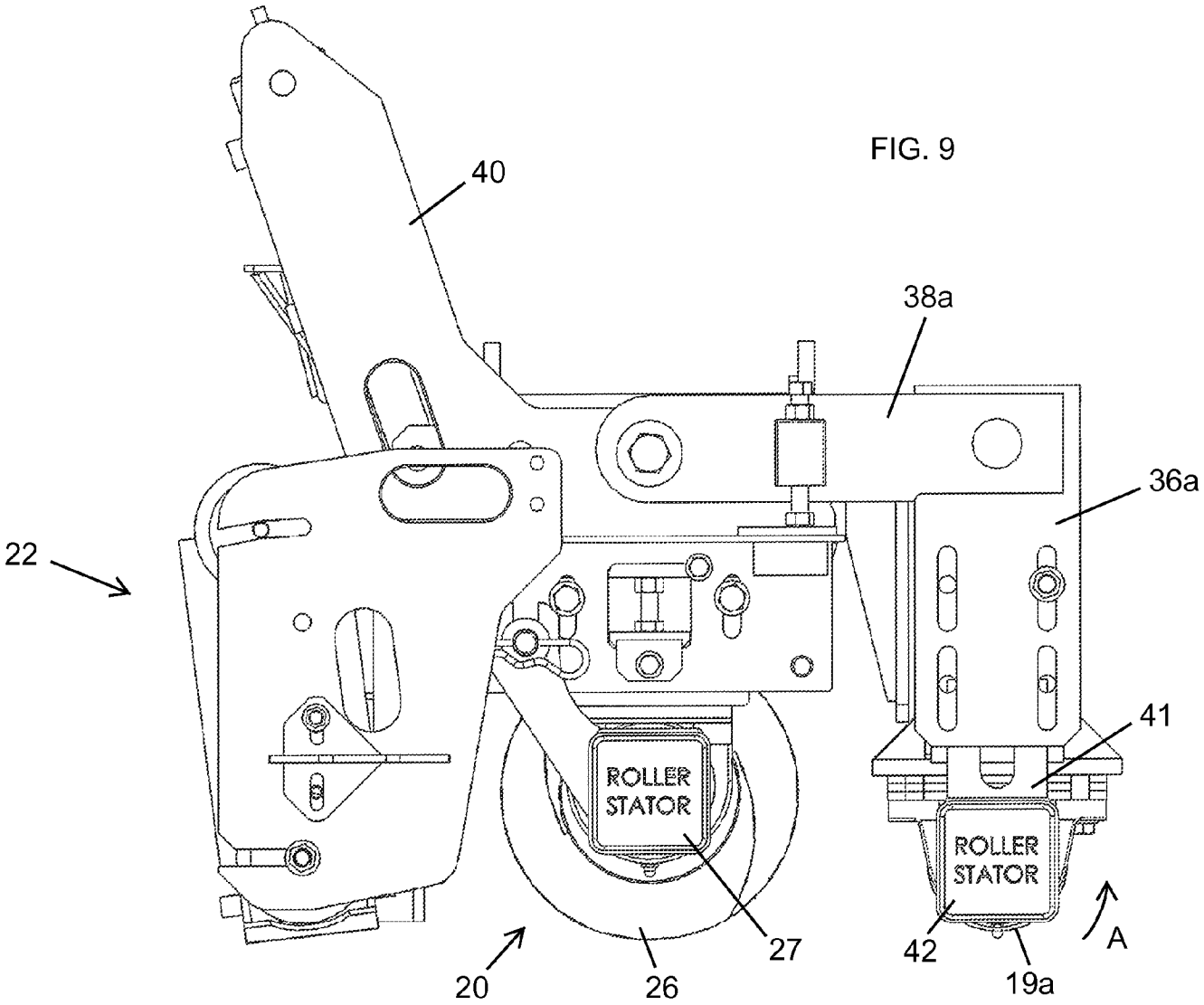
FIG. 9 is an end elevation of the screed head apparatus of FIG. 2.

Optionally, and particularly for applications where the rollers are rotatably driven in the direction A in FIG. 9, the roller plow assembly 18 may include a wiper element 44 mounted at the mounting beam 34 and disposed at or in contact with the cylindrical surface of the rollers 19*a*, 19*b*, whereby, as the rollers are rotated about their longitudinal axes, the wiper element 44 wipes excess concrete from the rollers to limit or substantially preclude the excess concrete from rotating with the roller and being deposited at the concrete surface behind the roller plow 18 and in front of the auger 20. In the illustrated embodiment, and as best shown in FIGS. 6 and 14, the wiper element 44 comprises a rubber or plastic elongated element attached (such as via rivets or fasteners or any suitable fastening or attaching means) at a mounting strip or bracket 46 (such as a metal strip or bracket or the like), which is attached to the mounting beam 34 via a plurality of fasteners or the like.

Optionally, the bracket 46 may be adjustably attached at the beam 34 (such as via the fasteners being inserted into generally vertically oriented slots of the bracket) to allow for vertical adjustment of the bracket and wiper element relative to the beam and rollers. Thus, as the wiper element 44 (which may comprise a flexible rubber or plastic material) wears down during use, the wiper bracket 46 may be adjusted to reposition the wiper element relative to the roller so that the wiper element maintains the desired contact with or spacing from the roller during operation of the screeding machine. In the illustrated embodiment, the wiper element and bracket comprise two wiper elements and brackets mounted at opposite sides of the center bearing bracket, so that there is a wiper element associated with a respective roller of the roller plow assembly.

Figure 10:
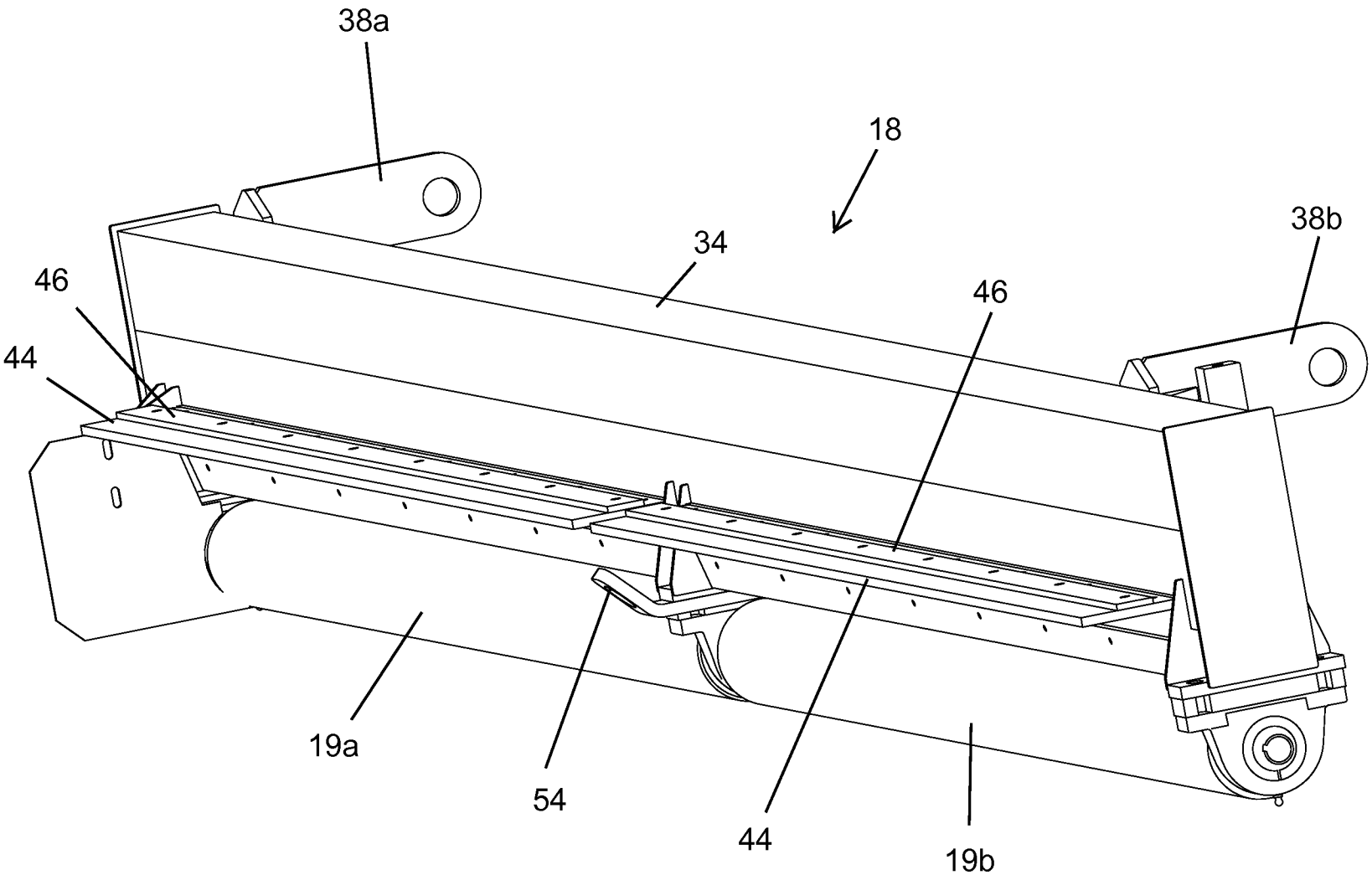
FIG. 10 is another perspective view of the roller plow assembly of the present invention, shown with the wiper elements pivoted away from the roller plow.

Optionally, and such as shown in FIG. 10, the wiper bracket 46 and wiper 44 may be pivotally mounted a the roller plow assembly 18, whereby the bracket 46 may pivot about a longitudinal axis to move the wiper 44 away from the roller plow or plows 19*a*, 19*b*. The bracket 46 may pivotally mount at the mounting beam 34, such as via any suitable means. For example, the bracket may hingedly attach at the mounting beam via one or more hinge elements, such as an elongated hinge element that spans at least a portion of the beam 34. Optionally, the hinge elements and/or the beam and/or the bracket include or engage one or more detent elements that retain the bracket and wiper at two or more locations or positions relative to the beam, such as a lowered or in use position (such as shown in FIG. 4) and a raised or non-use position (such as shown in FIG. 10). When in the raised position, the wiper may be cleaned and/or adjusted relative to the bracket, and may allow for access to and cleaning of the roller and bearings of the roller plow assembly.

Figure 11:
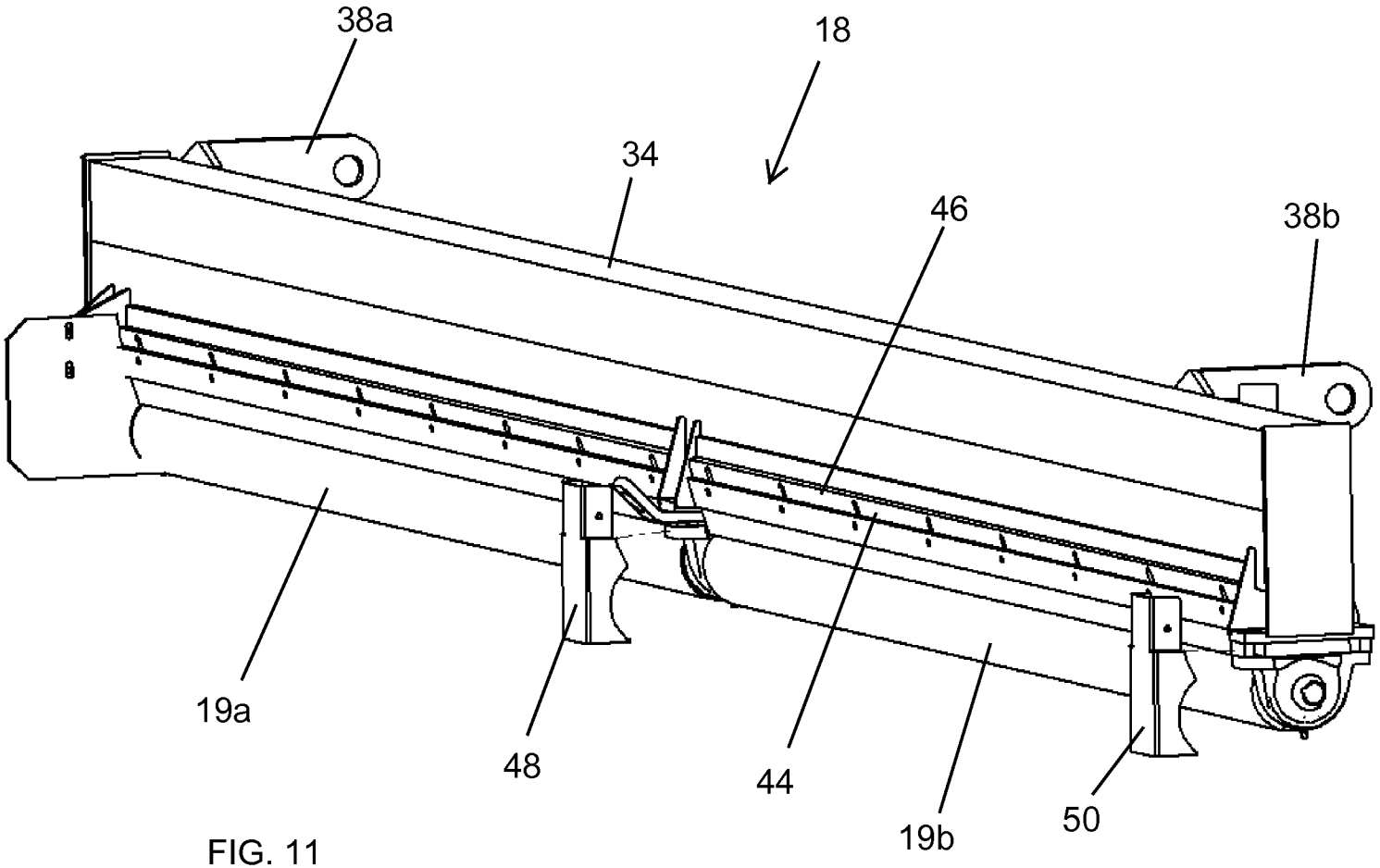
FIG. 11 is another perspective view of the roller plow assembly of the present invention, shown with bearing guards attached at the end and central bearings of the plow assembly to substantially encase and protect the bearings.
Figure 12:
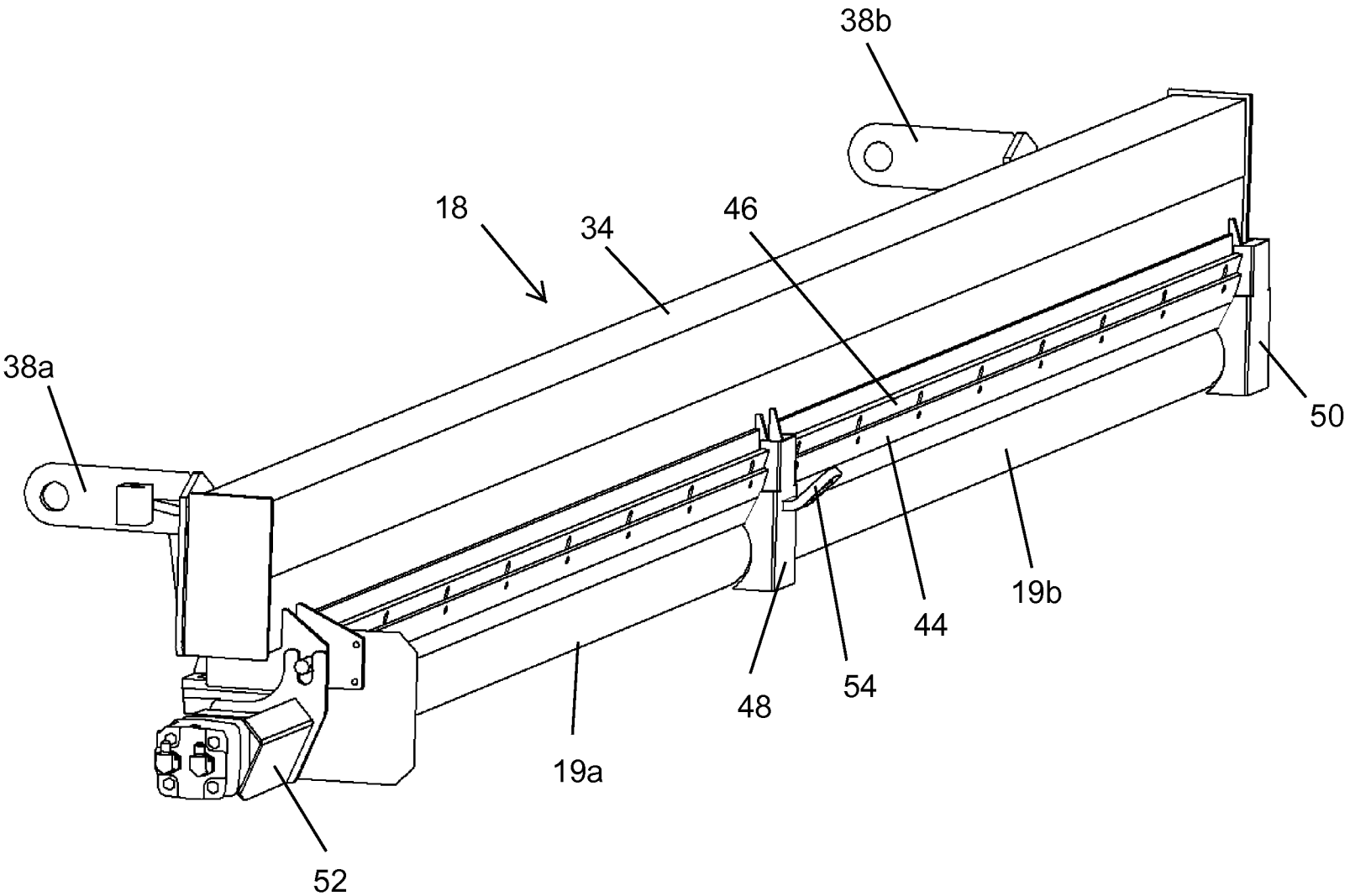
FIG. 12 is another perspective view of the roller plow assembly of the present invention, shown with a motor protector at the drive motor of the rotatable roller.

Optionally, and such as shown in FIGS. 11 and 12, the roller plow assembly 18 may include a central bearing guard or housing 48 that attaches at and substantially encases and houses the central bearing and an end bearing guard or housing 50 that attaches at and substantially encases and houses the end bearing. The housings or guards 48, 50 may detachably attach at the roller plow assembly so that, during use of the roller plow assembly, the guards may be attached to limit or substantially preclude uncured concrete from entering the bearing areas and, during non-use or cleaning or maintenance of the roller plow assembly, the guards may be removed to allow for access to the bearings. Optionally, a motor guard or plate 52 may be provided at the drive motor 42 to limit or substantially preclude uncured concrete from hitting the motor during a screeding process and drying at or on or around the motor.

Figure 13:
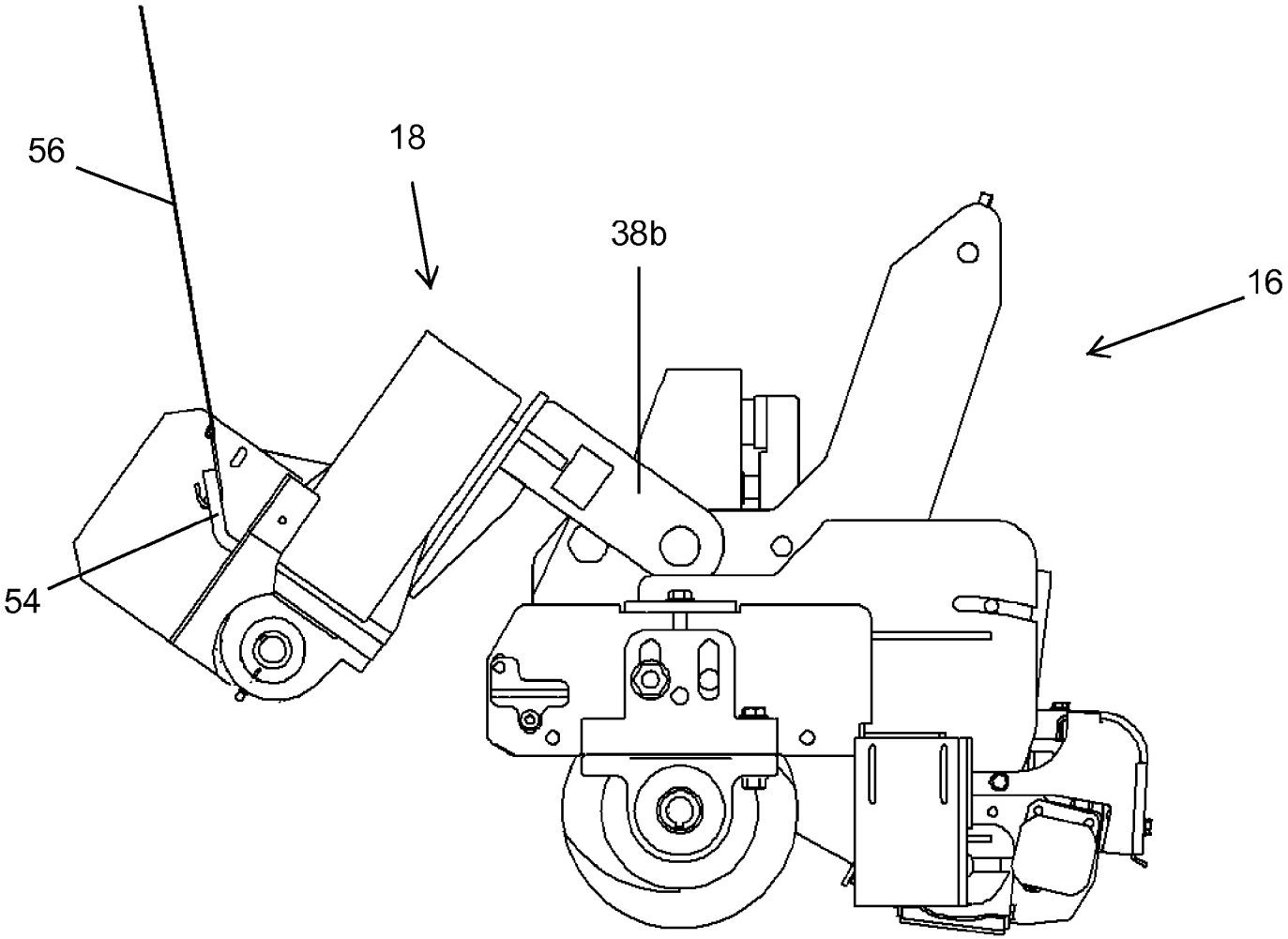
FIG. 13 is a side elevation of a screed head assembly with the roller plow assembly of the present invention, shown with the roller plow assembly pivoted away from the auger and screed head frame to allow for enhanced cleaning of the screed head assembly.

Optionally, the roller plow assembly may be pivotally attached at a screed head assembly to allow for pivotal movement of the plow assembly to move the plow away from the auger, such as for cleaning and/or maintenance of the screed head assembly. Optionally, for example, and such as shown in FIGS. 10-13, the central bearing mounting portion of the screed head assembly 18 may include a hook or tab 54, which extends forwardly of the rollers 19*a*, 19*b* and central bearing assembly 30 so as to provide a hook or hole that a lifting element or cable 56 (FIG. 13) can hook or engage for lifting and pivoting the roller plow assembly relative to the screed head to a cleaning or maintenance or non-use position, such as shown in FIG. 13.

Thus, the roller plow assembly of the present invention may be pivotally attached at a screed head assembly (comprising a vibratable member and an auger device). Optionally, the roller plow assembly may be provided as an aftermarket kit or add-on device, which may be attached to an existing screed head assembly (comprising a vibratable member and auger device). For example, a pin or bolt may be inserted through a mounting hole or aperture at the end of the respective mounting arm or bracket 38*a*, 38*b*, whereby the pin or bolt may attach at the frame of the screed head, such as via a fastener or the like at the screed head assembly. When so attached, the roller plow assembly may be positioned or oriented so that the roller plow or plows are disposed in front of the auger of the screed head, whereby the height of the roller plow or plows may be set relative to the auger as discussed above. The drive motor of the roller plow assembly or kit may then be readily connected to a control system of the screed head or screeding machine (such as a hydraulic system of the screed head or screeding machine and/or an electrical system of the screed head or screeding machine), whereby the drive motor may be selectively operated (and whereby the speed and rotational direction of the drive motor may be controlled)

by an operator of the screeding machine. Thus, the aftermarket roller plow assembly or kit may be readily mounted at an existing screed head of a screeding machine to provide enhanced screeding control and function to the screeding machine.

Figure 15:
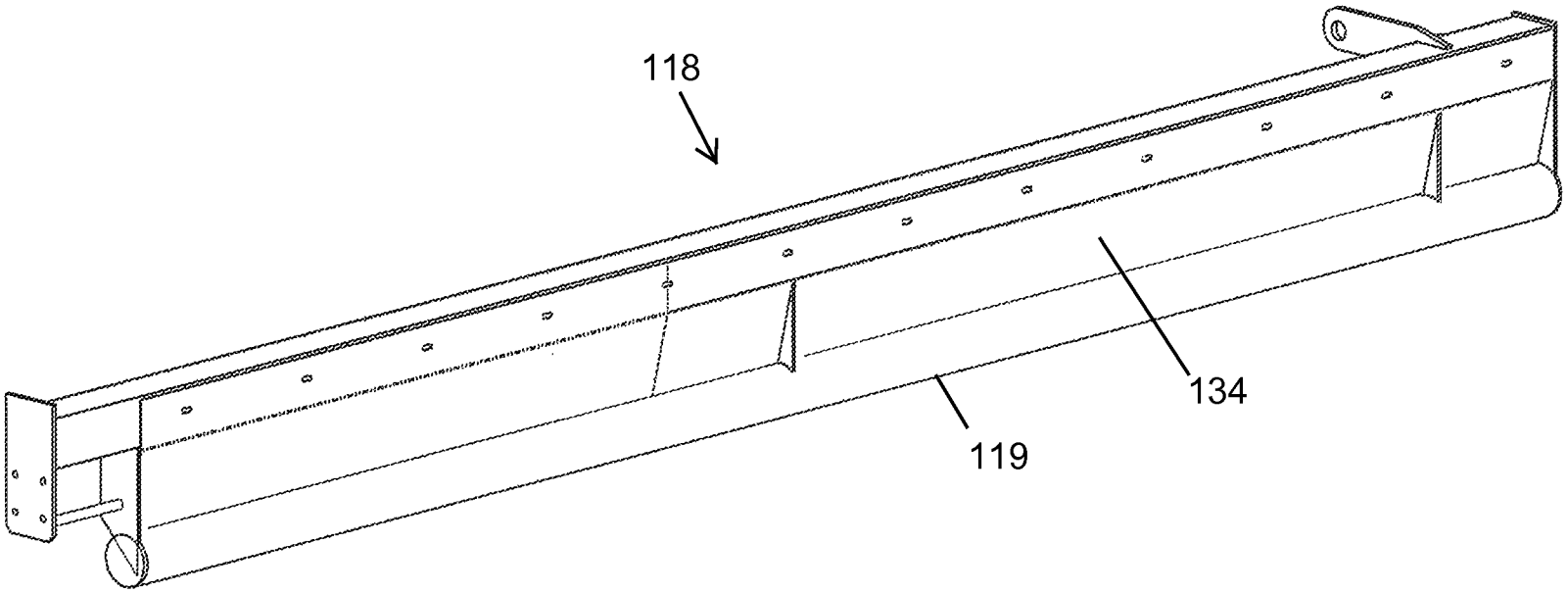
FIG. 15 is a perspective view of another plow assembly of the present invention, with a non-rotating cylindrical plow portion.
Figure 16:
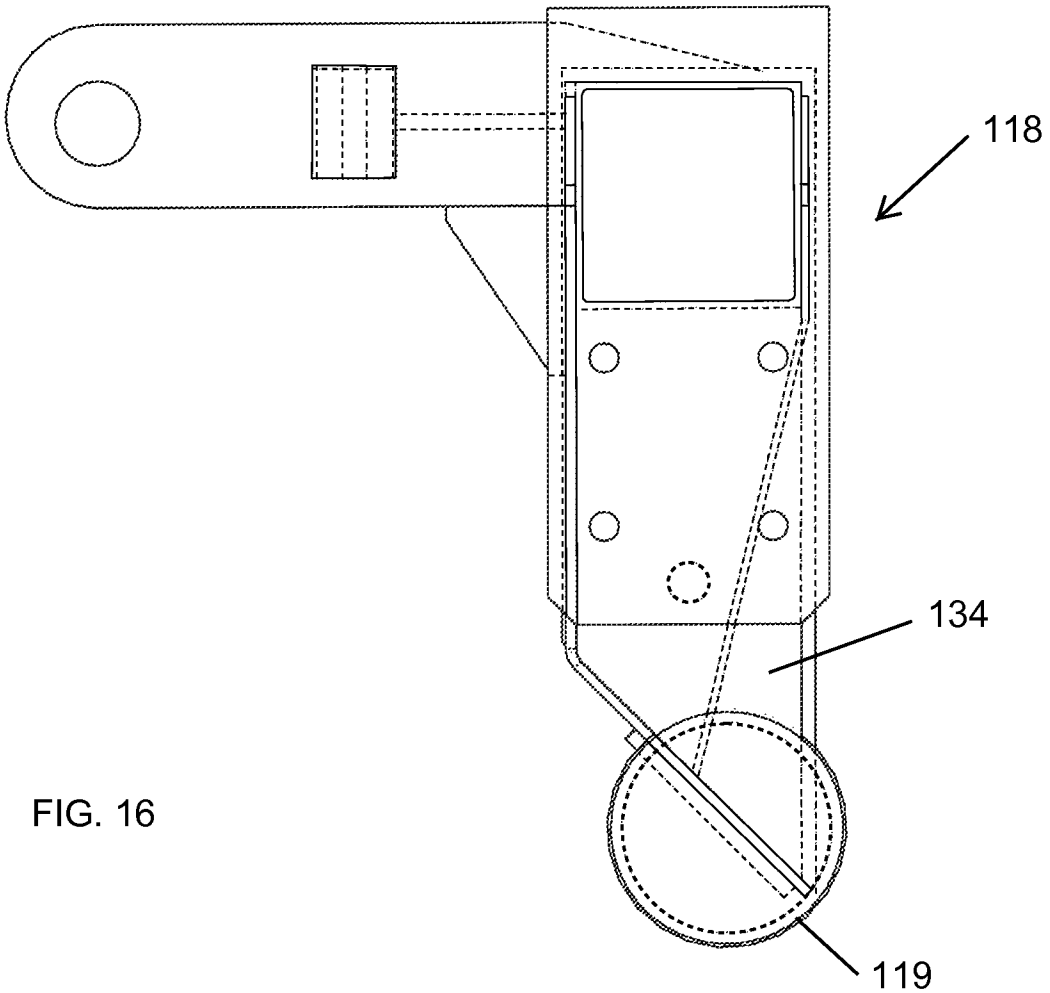
FIG. 16 is a side elevation of the plow assembly of FIG. 15.

Optionally, and such as shown in FIGS. 15 and 16, a roller plow assembly 118 may comprise a fixed or non-rotatable partial cylindrical concrete engaging surface 119. The curved or rounded or partial cylindrical surface 119 is configured to engage the concrete surface and slide therealong while pushing excess concrete in front of the roller plow and screed head as the screed head is moved over the concrete surface. The surface 119 may be established at a lower end of a mounting beam 134, which may be similar in construction to a conventional plow member or the like. The curved or rounded surface or profile functions to press any aggregate or stones into the uncured concrete as the screed head moves along the concrete surface and limit or substantially preclude dragging of stones (such as often occurs with conventional sharp-edged plow members). The screed head and roller plow 118 may be otherwise similar to the screed head 16 and roller plow 18, discussed above, such that a detailed discussion of the screed heads and roller plows need not be repeated herein.

Therefore, the present invention provides a roller plow assembly or device that has a roller element disposed ahead of the auger assembly of the screed head, whereby the rounded or curved profile or surface of the roller or rollers tends to press stones or aggregate into the concrete and limit or substantially preclude dragging of larger stones or aggregate as may occur during use of a conventional sharp edged plow. Because the roller plow limits such dragging of stones, the roller plow may be set at a level closer to the desired elevation or grade created by the auger than the typically higher level of a conventional plow, whereby the roller plow moves more excess concrete in front of the auger and the auger may process and move less concrete, thus increasing the effectiveness and efficiency of the auger. As the effectiveness and efficiency of the auger increases, the accuracy of the auger as a concrete leveling device improves. This improved accuracy results in a measurable improvement of the flatness and levelness of a screeded concrete surface by the machines and apparatuses described herein. Additionally, the roller plow device of the present invention is further suitable for processing any type of stiff, low-slump and/or difficult to level and screed uncured concrete and may be particularly suited for various concrete compositions or mixes or mix designs, such as fiber reinforced concrete mixes or compositions and/or the like. Thus, the present invention represents an improvement over prior art machines and methods used in the concrete construction industry.

Changes and modifications to the specifically described embodiments can be carried out without departing from the principles of the present invention, which is intended to be limited only by the scope of the appended claims as interpreted according to the principles of patent law.

The invention claimed is:

1. A roller plow kit for attachment at a screed head of a screeding machine to provide a roller plow at said screed head to establish a grade of uncured concrete in front of at least a vibrating member of said screed head, said roller plow kit comprising:

a roller plow assembly comprising a motor, a roller plow frame, end brackets and a roller configured to be rotatably disposed between said end brackets;

wherein said end brackets are configured for attachment at said screed head;

wherein said roller is attached at said end brackets via respective axle ends of said roller and respective support bearings and is rotatable about a longitudinal axis;

wherein said motor is disposed at one of said end brackets and is operable to rotatably drive said roller relative to said end brackets;

wherein, with said end brackets attached at said screed head, said motor is connectable to a control system of said screeding machine so that an operator of said screeding machine can control said motor to rotate said roller plow while screeding uncured concrete with said screeding machine, and wherein said motor of said roller plow assembly is operable independent of said vibrating member of said screeding machine.

2. The roller plow kit of claim 1, wherein said roller comprises two longitudinally aligned rollers, each having an outboard end supported at respective support bearings of respective end brackets and an inboard end supported at a central bearing of said roller plow kit, wherein said central bearing is configured for attachment at said frame of said roller plow assembly.

3. The roller plow kit of claim 1, wherein said end brackets are configured to pivotally attach at said screed head and wherein, with said end brackets pivotally attached at said screed head, said end brackets are pivotable to movably position said roller at one of a use position, where said roller is positioned generally in front of said vibrating member of said screed head, and a non-use position, where said roller is positioned away from and generally above and forward of said vibrating member of said screed head.

4. The roller plow kit of claim 1, comprising a wiping element disposed along said roller and configured to wipe concrete from the outer surface of said roller during operation of said roller plow assembly when said end brackets are attached at said screed head.

5. The roller plow kit of claim 4, wherein said wiping element is adjustably disposed at said frame of said roller plow assembly to adjust a clearance between said wiping element and the outer surface of said roller.

6. The roller plow kit of claim 5, wherein said wiping element is pivotally mounted at said frame and is pivotable between a use position, where said wiping element is positioned at or near said roller for wiping concrete from the outer surface of said roller, and a non-use position, where said wiping element is positioned away from said roller for access to said wiping element and said roller.

7. The roller plow kit of claim 1, wherein said end brackets are adjustable to allow for vertical adjustment of said plow relative to said vibrating member when said end brackets are attached at said screed head.

8. The roller plow kit of claim 7, comprising shim plates at at least one end of said roller to adjust a height of said support bearing at said at least one end of said roller.

9. The roller plow kit of claim 7, wherein said motor is at least one of (i) electrically connectable to an electronic control system of said screeding machine and (ii) hydraulically connectable to a hydraulic control system of said screeding machine.

10. A method of providing a roller plow kit at a screed head of a screeding machine, said method comprising:

providing a screed head comprising a vibratable member and an auger device disposed in front of said vibratable member in a screed pass direction;

providing a roller plow kit comprising a roller plow assembly having a motor, a frame, end brackets and a pair of rollers configured to be longitudinally aligned and rotatably disposed between said end brackets, wherein said rollers are rotatable about a longitudinal axis, and wherein outboard ends of said rollers are attached at respective support bearings at said end brackets and inboard ends of said rollers are attached at a central support bearing of said roller plow assembly;

attaching said end brackets and said central support bearing at a frame of said screed head, wherein, with said end brackets attached to said frame of said screed head, said rollers are disposed in front of said auger device in the screed pass direction; and connecting a motor of said roller plow assembly to a control system of at least one of said screed head and said screeding machine, wherein said motor, when connected to said control system, is operable to rotatably drive said rollers relative to said support bearings and said end brackets, and wherein said motor of said roller plow assembly is operable independent of said vibratable member of said screeding machine.

11. The method of claim 10, wherein attaching said end brackets comprises pivotally attaching said end brackets to said frame of said screed head, wherein, with said end brackets pivotally attached to said frame of said screed head, said end brackets are pivotable to movably position said rollers at one of a use position, where said rollers are positioned generally in front of said auger device, and a non-use position, where said rollers are positioned away from and generally above and forward of said auger device.

12. The method of claim 10, wherein said roller plow assembly comprises at least one wiping element disposed along said rollers and configured to wipe concrete from the outer surface of said rollers during operation of said roller plow assembly.

13. The method of claim 12, wherein said wiping element is adjustably disposed at said frame of said roller plow assembly to adjust a clearance between said wiping element and the outer surface of said rollers.

14. The method of claim 12, wherein said wiping element is pivotally mounted at said frame of said roller plow assembly and is pivotable between a use position, where said wiping element is positioned at or near said roller for wiping concrete from the outer surface of said rollers, and a non-use position, where said wiping element is positioned away from said rollers for access to said wiping element and said rollers.

15. The method of claim 9, comprising vertically adjusting said rollers relative to said end brackets when said end brackets are attached to said frame of said screed head.

16. The method of claim 9, wherein connecting said motor of said roller plow assembly to said control system comprises at least one of (i) electrically connecting said motor to an electronic control system and (ii) hydraulically connecting said motor to a hydraulic control system.

* * * * *